US005144759A

United States Patent [19]

Mascotte

[11] Patent Number: 5,144,759

[45] Date of Patent: Sep. 8, 1992

[54] SHOE-COVERING MEMBERS

[76] Inventor: Lawrence L. Mascotte, 9106 SE. 82nd, Portland, Oreg. 97266

[21] Appl. No.: 529,774

[22] Filed: May 31, 1990

Related U.S. Application Data

[63] Continuation of Ser. No. 315,586, Feb. 27, 1989, abandoned.

[51] Int. Cl.[5] ..... A43B 3/16

[52] U.S. Cl. ..... 36/71 R; 36/72 R

[58] Field of Search ..... 36/7.1 R, 72 R, 1.5, 36/2 R, 101, 7.2

[56] References Cited

U.S. PATENT DOCUMENTS

| | | | |
|---|---|---|---|
| 1,090,223 | 3/1914 | McNeer | 36/1.5 |
| 2,068,946 | 1/1937 | Ferguson | 36/72 R |
| 2,097,200 | 10/1937 | Menutole | 36/1.5 |
| 2,099,476 | 11/1937 | Glowka | 36/2 R |
| 2,229,563 | 1/1941 | Greenstein | 36/72 R |
| 3,744,158 | 7/1973 | Walker | 36/1.5 |
| 4,713,895 | 12/1987 | Vallieres | 36/7.1 R |

FOREIGN PATENT DOCUMENTS

| | | | |
|---|---|---|---|
| 636475 | 4/1928 | France | 36/2 R |

*Primary Examiner*—Steven N. Meyers
*Attorney, Agent, or Firm*—Adrian J. La Rue

[57] ABSTRACT

A shoe covering member comprises a covering member having a shape conforming to an upper section of a shoe over which it is to cover. A bottom section of the covering member is sealingly engaged with a sole of the shoe and the covering member is provided with a fold at its rear end which is fastened in a folded condition to snugly engage the upper section of the shoe.

6 Claims, 1 Drawing Sheet

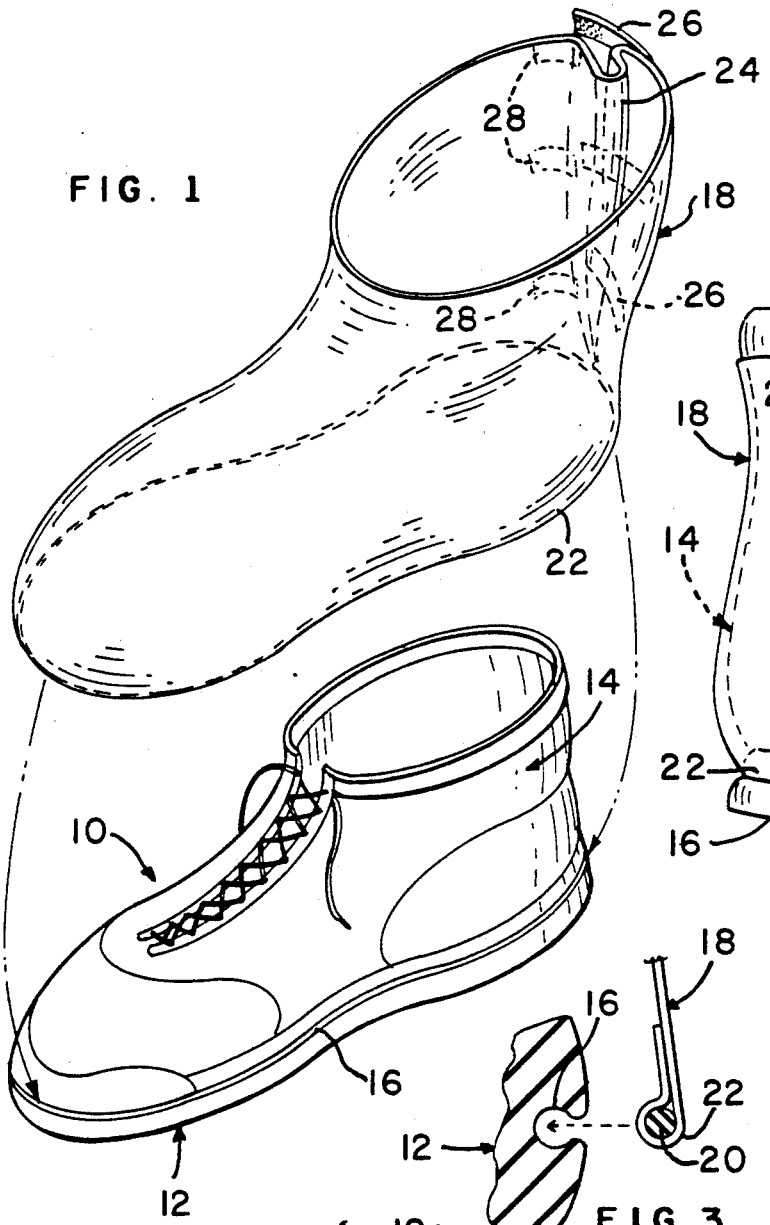
FIG. 1
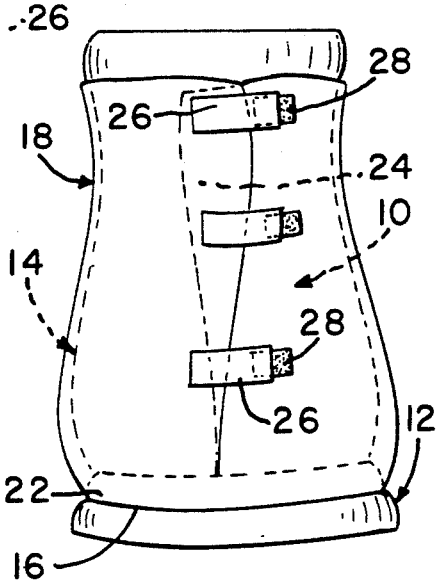
FIG. 2
FIG. 3
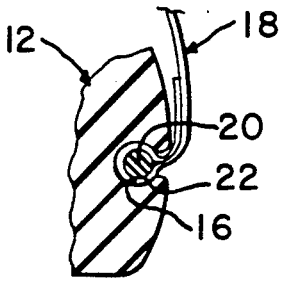
FIG. 4
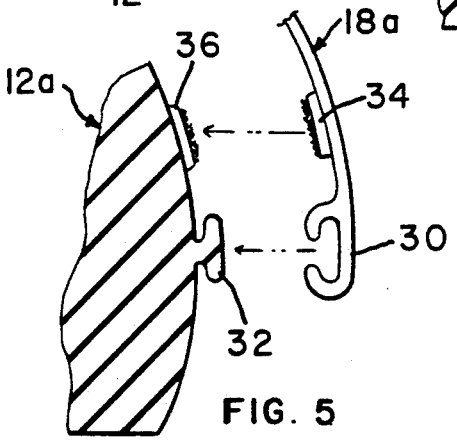
FIG. 5
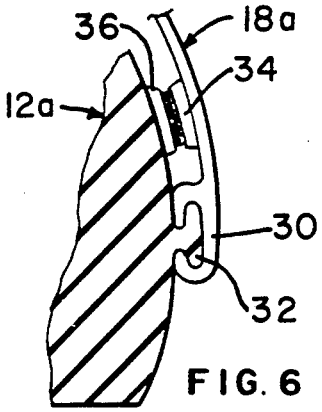
FIG. 6

SHOE-COVERING MEMBERS

This application is a continuation of application Ser. No. 07/315,586 filed Feb. 27, 1989, now abandoned.

FIELD OF THE INVENTION

This invention relates to covering members and more particularly to covering members for shoes.

BACKGROUND OF THE INVENTION

Walking or jogging shoes normally have a molded rubber or rubber-like sole while the upper part of the shoes can be leather or synthetic or man-made material such as nylon or a combination of leather and synthetic material. These shoes can also be used for bicycling. They are lightweight so as not to add extra weight to the walker or jogger. When the shoes are used during rain or wet conditions, the shoes absorb water which increases their weight and causes the feet to be uncomfortable in the wet shoes. Thus, it is important to keep water from wetting the shoes during rainy or wet conditions.

SUMMARY OF THE INVENTION

According to the present invention, shoe covering members are in the form of upper members for covering the respective upper members of a pair of shoes, the side surfaces of the shoes and the bottom ends of the covering members being provided with securing means for securing the bottom ends of the covering members to the shoe soles, and the covering members including means for fitting the covering members snugly onto the upper members of the shoes or the ankles of the person. The covering members are made of a material that breathes but keeps water from passing through.

BRIEF DESCRIPTION OF THE DRAWINGS

The invention, together with objects and advantages thereof, is best understood by way of example by reference to the following detailed description in conjunction with the accompanying drawings.

FIG. 1 is an exploded perspective view of a shoe and shoe covering member.

FIG. 2 is a rear elevational view, showing the covering member on the shoe.

FIGS. 3 and 4 are part cross-sectional views of the shoe sole and bottom section of the covering member showing the securing of the bottom section in the sole.

FIGS. 5 and 6 are views similar to FIGS. 3 and 4 showing an alternative embodiment for the securing of the bottom section of the covering member to the shoe sole.

DETAILED DESCRIPTION OF THE INVENTION

As shown in FIGS. 1–4, a conventional shoe 10 is of the type that is normally referred to as walking, jogging or athletic shoes which include a sole 12 and an upper section 14.

Sole 12 is molded from a suitable rubber or rubber-like material and is affixed to upper section 14 in accordance with conventional shoe-making practices. Sole 12 has an arcuate groove or recess 16 formed therein during the molding process and it extends along the entire side surface of sole 12. As can be seen from FIG. 3, recess 16 is about three quarters of a circle.

Upper section 14 can be made from leather or synthetic, which is otherwise known as man-made material, or a combination of leather and synthetic material. Moisture, as a result of rain, can cause upper sections 14 of the shoes to get wet when the shoes are worn when walking, jogging, riding a bicycle or other activity during the time rain is falling or when the ground, roadway or walkway is wet. The wet shoes add weight, especially during walking and jogging, and cause the feet to be uncomfortable which detracts from the activity in which the person is involved.

In order to prevent the shoes from getting wet, shoe covering members 18 cover upper sections 14 and have their bottom ends sealingly connected to the soles 12 of shoes 10. Each shoe covering member 18 is in the form of an upper section of a shoe as shown in FIGS. 1 and 2 and is made from a suitable material to prevent water from passing therethrough. A preferable material is one that is breathable whereby air molecules can pass through the material but water molecules cannot thereby enabling the feet to breathe without becoming wet from the rain water. The material is lightweight and does not add undue weight to the shoes when the covering members are placed thereover. The shoe covering members can thus be easily carried and installed onto the shoes when needed.

An O-ring member 20, which is made from a suitable elastic material, is secured in an overlapped bottom end 22 of covering member 18 as shown in FIGS. 3 and 4. The O-ring 20 and overlapped end 22 of covering member 18 are forcefully pushed into recess 16 in sole 12 of shoe 10 thereby sealingly securing covering member 18 onto sole 12 while the upper part of covering member 18 covers upper section 14 of shoe 10.

O-ring 20 is of a size so that it can be used in a range of sizes of shoes due to its elasticity. The same is true of the material of covering member 18. Overlapped bottom end 22 is secured in place by an adhesive or by other conventional means.

In order for covering member 18 to be snugly engaged with upper section 14 of shoe 10, a fold 24 is located along the back or rear section of covering member 18, as shown in FIGS. 1 and 2, and it forms a triangle when it is folded. Sections 26, 28 of fastening members sold under the VELCRO trademark are provided along fold 24 to form the V-shaped fold when they are in engagement thereby causing covering member 18 to snugly engage upper section 14 of shoe 10 as shown in FIG. 2. As can be discerned, the apex of triangular-shaped fold 24 is adjacent overlapped end 22 whereas the base is at the top section of covering member 18. Other types of fastening devices can of course be used if desired.

The top section of covering member 18 can extend above upper section 14 of shoe 10 and engage the leg of the person if desired.

FIGS. 5 and 6 show alternative structure for securing the bottom section of covering member **18*a* to sole 12*a*. Covering member 18*a* has a C-shaped member 30 at its bottom section which is sealingly matable onto an oblong projection 32 disposed along the side surface of sole 12*a*. If desired, VELCRO fastening members 34, 36 can be disposed respectively along an inside surface of covering member 18*a* above C-shaped member 30 and along the side surface of sole 12*a* above oblong projection 32 to assure that member 30 is maintained onto projection 32. Fastening members 34, 36 can be located at spaced locations instead of extending completely along covering member 18***a* and sole 12*a*.

To place covering member 18 onto shoe 10, fold 24 is unfolded and the toe of the shoe on a person's foot is inserted through the top section of the covering member and it is pulled onto the shoe. Thereafter, overlapped end 22 and O-ring 20 are pushed into recess 16 and fastening members 26, 28 fastened together whereby covering member 18 is sealingly and snugly positioned onto shoe 10.

As can be discerned, a lightweight and waterproof covering member for covering shoes has been disclosed which is sealingly connected to soles of the shoes and snugly engaged with upper sections thereof.

What is claimed is:

1. A shoe and a shoe-covering member therefor, comprising:

a shoe having a sole section and an upper section, said sole section having a sealing member extending entirely along a side surface thereof;

a covering member of a water-impermeable material having a shape conforming to the upper section of said shoe and being positionable thereover;

a matable sealing member extending entirely along a bottom end of said covering member and being matably and sealingly engageable with said sealing member of said sole section of said shoe to prevent water from passing through the mated sealing members to the upper section of the shoe; and means on said covering member for snugly maintaining the covering member in engagement with the upper section of the shoe.

2. A shoe-covering member as claimed in claim 1, wherein the snugly-maintaining means comprises a fold at a back end of said covering member which has a V-shaped configuration when folded, and fastening means on said covering member for maintaining the V-shaped fold in the folded condition.

3. A shoe and a shoe-covering member therefor as claimed in claim 1, wherein the sealing member along the side surface of the sole section comprises a recess and the matable sealing member includes an overlapped bottom section of said covering member in which an elastic O-ring is secured, the overlapped bottom section with the O-ring therein being insertable in said recess.

4. A shoe and a shoe-covering member therefor as claimed in claim 1, wherein the sealing member along the side surface of the sole section comprises an oblong projection and the matable sealing member includes a C-shaped member being pressed onto said oblong projection.

5. A shoe and shoe-covering member therefor as claimed in claim 4, wherein fastening means are located on an inside surface of said covering member above said C-shaped member for fastening engagement with matable fastening means along the side surface of the sole section above said oblong projection.

6. A shoe-covering member for covering an upper section of a shoe and for sealing engagement with a sealing member extending entirely along a side surface of a sole section of the shoe, comprising:

a covering member of a water-impermeable material having a shape conforming to the upper section of the shoe when the covering member is placed thereover;

a matable sealing member extending entirely along a bottom end of said covering member and being sealingly matable with the sealing member on the sole section of the shoe to prevent water from passing through the mated sealing members to the upper section of the shoe; and means on said covering member for snugly maintaining the covering member in engagement with the upper section of the shoe.

* * * * *